US009016475B2

(12) United States Patent
Chen

(10) Patent No.: US 9,016,475 B2
(45) Date of Patent: Apr. 28, 2015

(54) PAPER-MADE PACKING BOX WITH SHOCK-ABSORBING DEVICE

(71) Applicant: Joy Industrial Co., Ltd., Taichung Hsien (TW)

(72) Inventor: Chun-Hsung Chen, Taichung Hsien (TW)

(73) Assignee: Joy Industrial Co., Ltd., Taichung Hsien (TW)

( * ) Notice: Subject to any disclaimer, the term of this patent is extended or adjusted under 35 U.S.C. 154(b) by 306 days.

(21) Appl. No.: 13/713,321

(22) Filed: Dec. 13, 2012

(65) Prior Publication Data

US 2014/0166531 A1 Jun. 19, 2014

(51) Int. Cl.

| | |
|---|---|
| ***B65D 81/02*** | (2006.01) |
| ***B65D 85/30*** | (2006.01) |
| ***B65D 81/07*** | (2006.01) |
| *B65D 5/02* | (2006.01) |
| *B65D 5/42* | (2006.01) |

(52) U.S. Cl.

CPC ..... *B65D 81/022* (2013.01); *B65D 81/07* (2013.01); *B65D 5/0209* (2013.01); *B65D 5/029* (2013.01); *B65D 5/4204* (2013.01); *B65D 5/4208* (2013.01); *B65D 2585/6882* (2013.01); *Y10S 206/806* (2013.01)

(58) Field of Classification Search

CPC .... B65D 81/07; B65D 81/075; B65D 81/022; B65D 81/0209; B65D 5/029; B65D 5/0209

USPC ..... 206/461, 485, 486, 488–490, 521, 583, 206/588, 590–594, 525.1, 806; 229/147–150, 154, 167, 168

See application file for complete search history.

(56) References Cited

U.S. PATENT DOCUMENTS

| | | | | |
|---|---|---|---|---|
| 2,448,401 | A * | 8/1948 | Stone | 206/590 |
| 2,939,622 | A * | 6/1960 | D Ippolito | 206/485 |
| 3,211,282 | A * | 10/1965 | Hennessey | 206/590 |
| 3,820,708 | A * | 6/1974 | Sieffert | 206/592 |
| 3,820,709 | A * | 6/1974 | Sieffert | 206/592 |
| 5,145,070 | A * | 9/1992 | Pallett et al. | 206/521 |
| 6,105,759 | A * | 8/2000 | Fuchs et al. | 206/485 |
| 6,675,970 | B1 * | 1/2004 | Nemoto | 206/521 |
| 7,097,043 | B2 * | 8/2006 | Hsu | 206/588 |
| 8,453,918 | B2 * | 6/2013 | Hsiao et al. | 206/806 |
| 2005/0061759 | A1 * | 3/2005 | Doucette | 206/806 |
| 2006/0196805 | A1 * | 9/2006 | Park | 206/594 |

* cited by examiner

*Primary Examiner* — Luan K Bui

(74) *Attorney, Agent, or Firm* — Rosenberg, Klein & Lee

(57) ABSTRACT

A packing box comprises a peripheral portion and two end portions are respectively connected to two ends of the peripheral portion. A shock-absorbing device has two support members located on the two ends of the peripheral portion, and the two support members each are bent to be a U-shaped member and linearly movable toward the end portion corresponding thereto. At least one positioning portion is connected to each of the support members so as to retain an object. The object can be moved with the support members so as to absorb the vibration and impacts.

12 Claims, 16 Drawing Sheets

PAPER-MADE PACKING BOX WITH SHOCK-ABSORBING DEVICE

FIELD OF THE INVENTION

The present invention relates to a paper-made packing box for displaying object therein, and more particularly, to a paper-made packing box with a shock-absorbing device located therein so as to protect the object in the packing box.

BACKGROUND OF THE INVENTION

The conventional packing boxes for display objects can be cataloged into two types, one of which partially packs the object and the other one fully packs the object in the box.

The conventional packing boxes are developed with convenient handles, commercial advertisement surfaces, outer appearances, and shock-absorbing feature.

For the packing box with shock-absorbing feature, polymer particles or boards and bubble sheets are used to wrap the object so as to protect the object from being damaged by vibration or impacts. The latest packing box has multiple positioning recesses defined by folding flaps of the box and preferably, the packing box is made by a single paper sheet.

Taiwan Utility Model Application No. 097101935 discloses a packing box with two side panels and two support portions are formed on the underside of the packing box. Each of the support portions has a top face, a bottom face, a first side face connected with the first side panel and a second side face located corresponding to the first side face. The side panels are folded toward the interior of the packing box so as to form the bottom face, the second side face, the top face and the first side face in sequence. The top face and the second side face respectively have a notch facing the recessed area of the support portions.

Taiwan Utility Model Application No. 098200169 discloses a packing box with a cover connected to two side panels thereof, a bottom plate and multiple folded plates. The multiple separation plates are located between the cover, the bottom plate and the folded plates. The outmost separation plate has a connection plate and the separation plate located close to the bottom plate has a hole. The folded plates each have a positioning hole and the position holes are located corresponding to each other.

Taiwan Utility Model Application No. 100212177 shows a packing box with multiple connected side walls and the walls comprise a top wall, a side wall and a bottom wall. The side wall comprises a first side wall connected between the top wall and the bottom wall, and a second side wall connected to the bottom wall. A folding line is defined between the top wall and the first side wall, another folding line is defined between the first side wall and the bottom wall, yet another folding line is defined between the second side wall and the bottom wall. The second side wall is connected to the top wall so as to define the packing box with a hollow interior. The top wall is shaped geometrically and the shape has a folding line and a flap connected to folding line so as to retain an object.

Taiwan Utility Model Application No. 097101935 uses the recessed area of the support portions to position the object. Taiwan Utility Model Application No. 098200169 provides holes for position the object wherein the holes allow a larger sized object to be positioned. Taiwan Utility Model Application No. 100212177 uses the folding line to fold the related portion of the paper sheet to form recesses which are cooperated with flaps to position the object.

However, the shape and size of the objects are not fixed so that the packing boxes cannot meet the practical needs for positioning most of the objects. The manufacturing cost will be too high if the packing boxes are custom-made for different objects. Besides, the object in the packing box will be damaged when the packing box drops, this is because the conventional packing box lacks proper shock-absorbing device to absorb the shocks and impacts transferred to the object.

The present invention intends to provide a paper-made packing box with a shock-absorbing device located therein so as to protect the object in the packing box.

SUMMARY OF THE INVENTION

The present invention relates to a packing box and comprises a peripheral portion and two end portions are respectively connected to two ends of the peripheral portion. A shock-absorbing device has two support members located on the two ends of the peripheral portion, and the two support members each are bent to be a U-shaped member and linearly movable toward the end portion corresponding thereto. At least one positioning portion is connected to each of the support members so as to retain an object. The object is suspended and can be moved with the support members so that the energy coming from vibration and impacts is eliminated by the movement of the object with the support members.

The primary object of the present invention is to provide a packing box which has a shock-absorbing device which allows the object to swing within an acceptable range so as to eliminate the energy from vibration and impacts.

A second object of the present invention is to provide a packing box with two support members which swing back and forth to eliminate the energy from vibration and impacts.

A third object of the present invention is to provide a packing box which has a shock-absorbing device and two ends of the object is connected to the shock-absorbing device. The positioning portion of each of the support members of the shock-absorbing device can be adjusted to position the object.

A fourth object of the present invention is to provide a packing box which is made by cutting a single paper board and bending the paper board into a shock-absorbing device. The packing box is easily manufactured and used.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
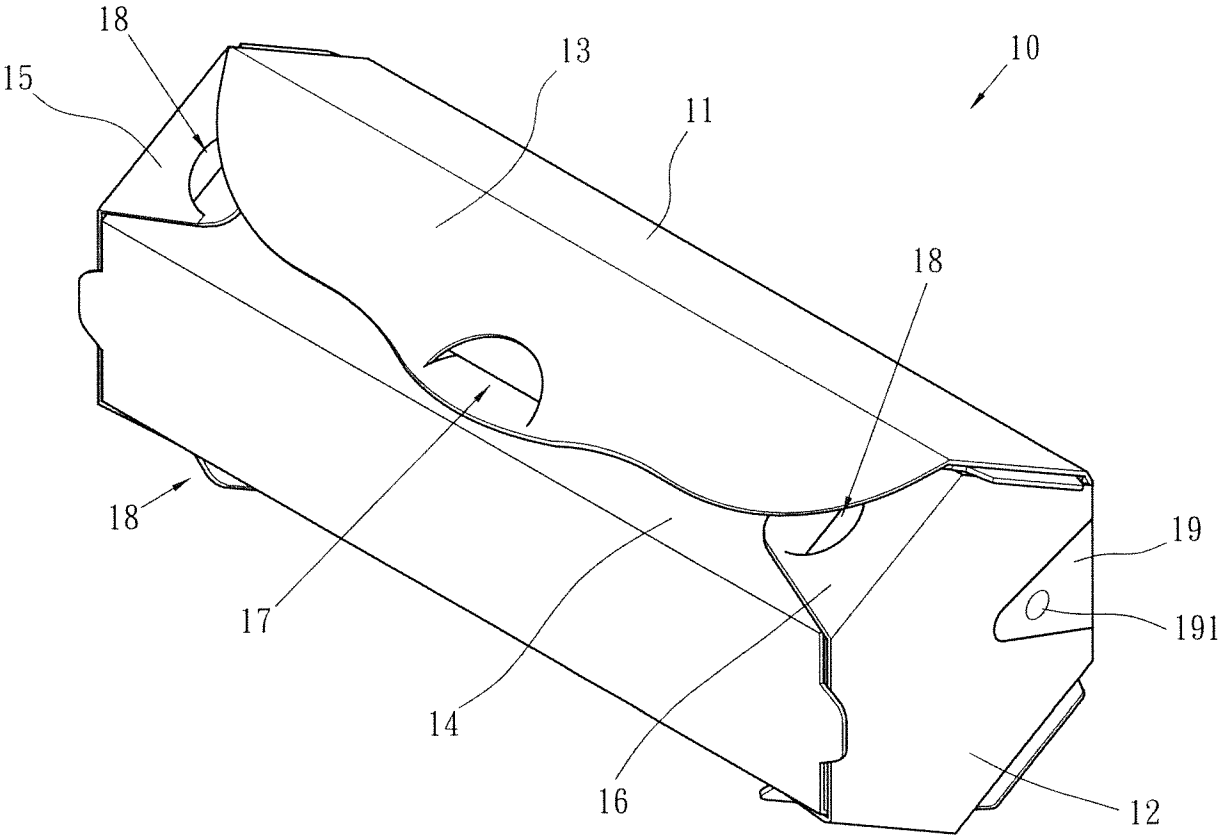
FIG. 1 is a perspective view to show the packing box of the present invention.
Figure 2:
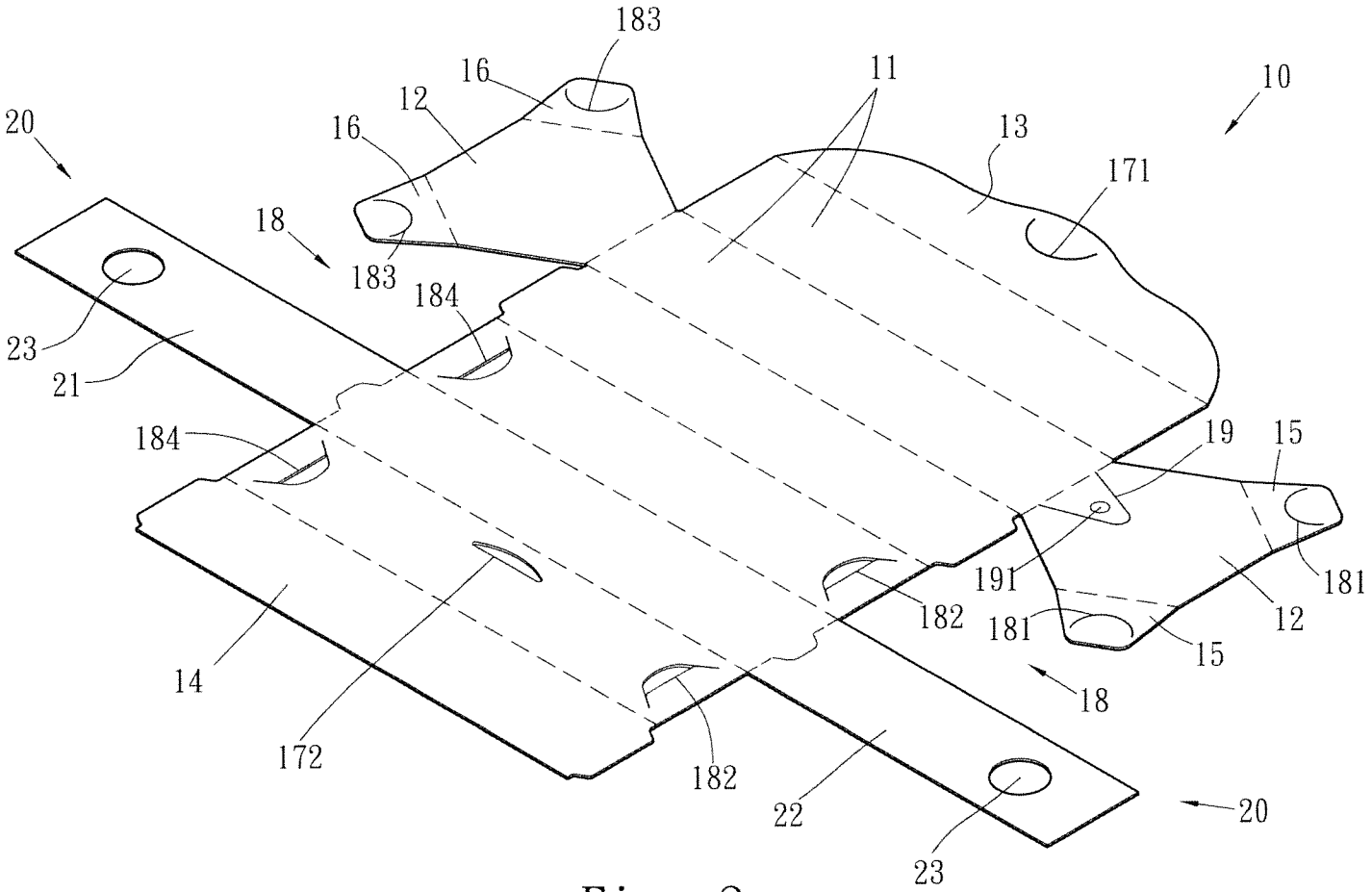
FIG. 2 shows that the packing box of the present invention is expanded.
Figure 3:
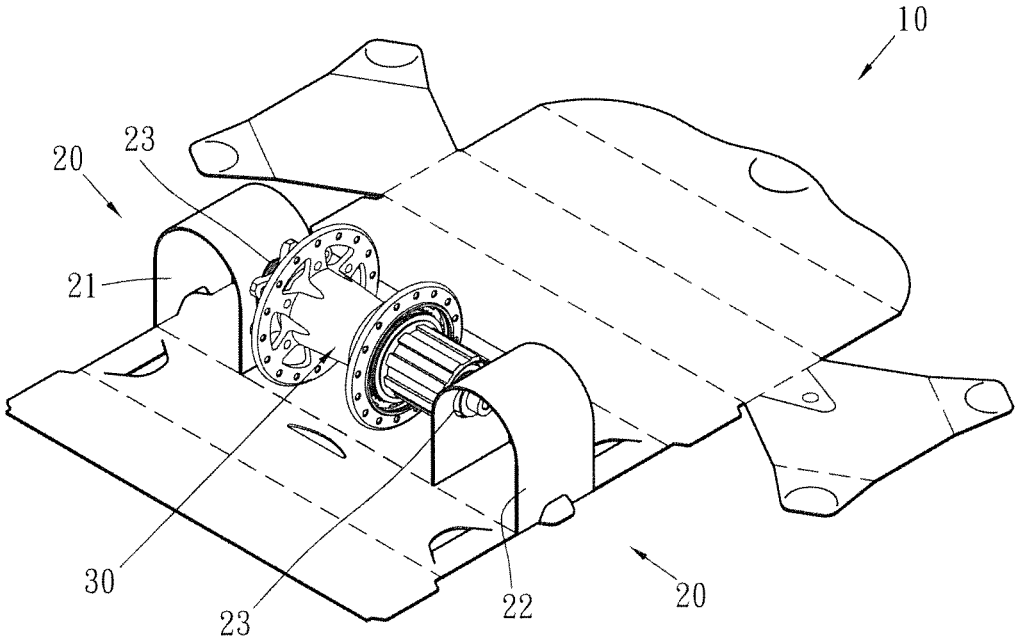
FIG. 3 shows an object is packed in the packing box which is in expanded status.

Referring to FIGS. 1 to 3, the packing box 10 of the present invention is a hexagonal box and comprises a peripheral portion 11 and two end portions 12 are respectively connected to two ends of the peripheral portion 11. The peripheral portion 11 has a first extension portion 13 and a second extension portion 14 extending from two sides thereof. A first engaging unit 17 has a first engaging portion 171 which is located at the first extension portion 13, and a second engaging portion 172 is located on the peripheral wall 11. When the peripheral portion 11, the first extension portion 13 and the second extension portion 14 are bent, the first and second engaging portions 171, 172 are connected to each other to maintain the packing box 10 and a space in the packing box 10. A second engaging unit 18 has a first engaging portion 181/183 located on the flap 15/16, and a second engaging portion 182/184 located on the peripheral portion 11. When the flaps 15, 16 are bent, the first and second engaging portions 181/183, 182/184 are connected to each other. The first engaging portion 171/181/182 has a protrusion which is made by partially cutting. The second engaging portion 172/183/184 has a hollow portion with which the first engaging portion 171/181/182 is engaged. One of the end portions 12 has a lug 19 which is cut from the end portion 12 and a hole 191 is defined through the lug 19, so that the packing box 10 can be hanged on a rod.

A shock-absorbing device 20 has two support members 21, 22 located on the two ends of the peripheral portion 11. The two support members 21, 22 each are inserted toward the interior of the packing box 10 and bent to be a U-shaped member. Each of the bent support members 21, 22 has a distal end which contacts the peripheral portion 11. A positioning portion 23 is defined in each of the support members 21, 22 and located close to the distal end of each support member 21/22 so that an object extends through the engaging portions 23 which is hanged or suspended by the support members 21, 22. The support members 21, 22 are linearly movable toward the end portion 12 corresponding thereto. The two support members 21, 22 swing back and forth to eliminate the energy from vibration and impacts, so that the object is protected.

When manufacturing the packing box 10, the paper board is cut by proper molds and cutting tools to form the peripheral portion 11 and the shock-absorbing device 20, wherein the cutting line is solid lines and the dotted lines are folding lines as shown in FIG. 2 Each of the first extension portion 13, the peripheral portion 11 and the second extension portion 14 is connected to each other. The two end portions 12 are connected to the two ends of the peripheral portion 11. Each end portion 12 has a flap 15/16. One of the end portions 12 has a lug 19 through which a hole 191 is defined. The two support members 21, 22 are located on the peripheral portion 11 and each of the support members 21, 22 has the positioning portion 23. The first and second engaging units 17, 18 are also formed wherein the first engaging portions 171, 181, 183 are located on the first extension portion 13 and the two flaps, and the second engaging portions 172, 182, 184 are formed on five positions of the peripheral portion 11.

Figure 4:
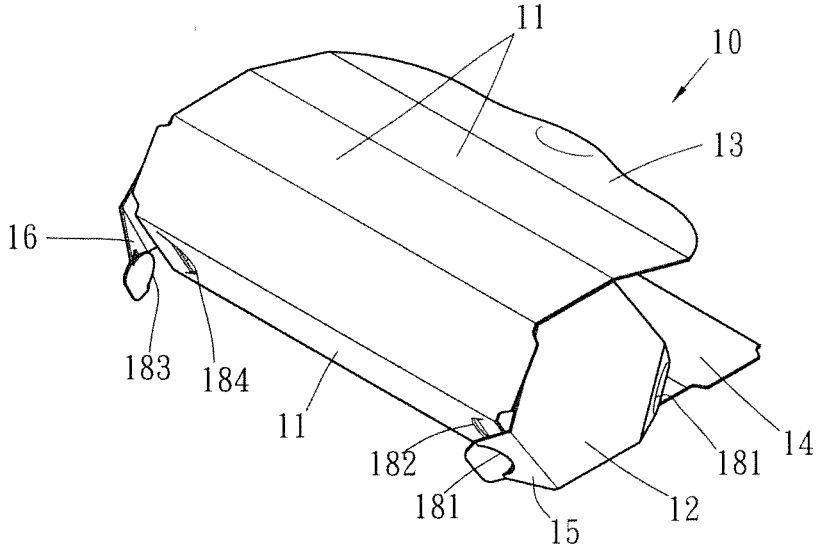
FIG. 4 shows the first and second extension portions of the packing box are to be connected to each other.
Figure 5:
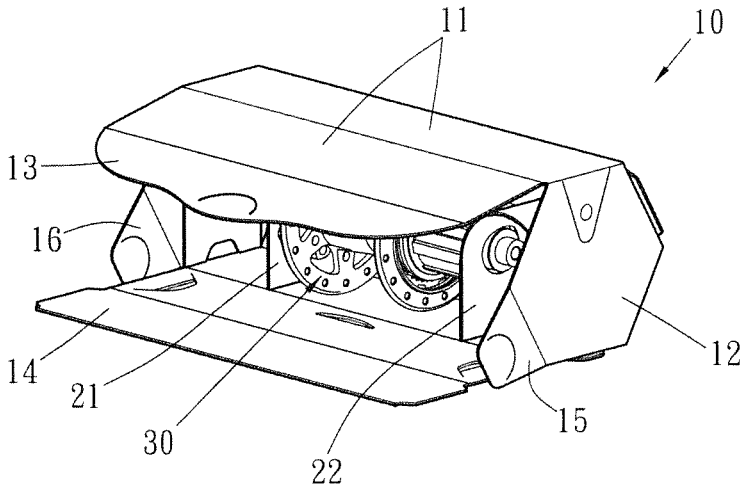
FIG. 5 is viewed from the other side of the packing box as shown in FIG. 4.
Figure 6:
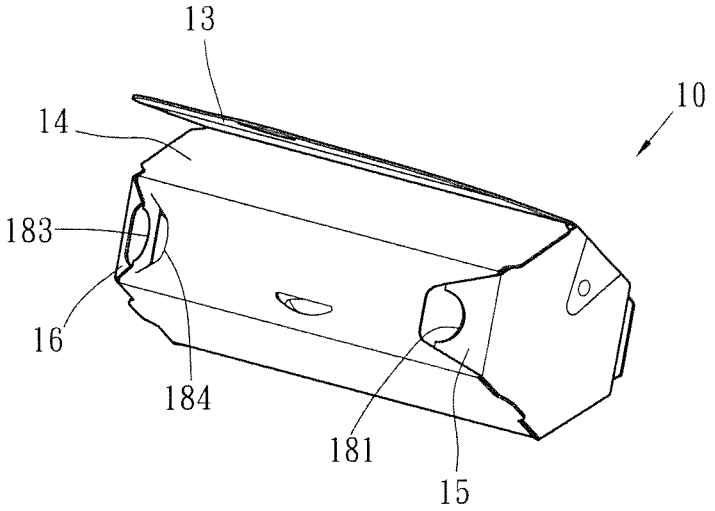
FIG. 6 shows that the second extension portion is folded before the first extension portion.
Figure 7:
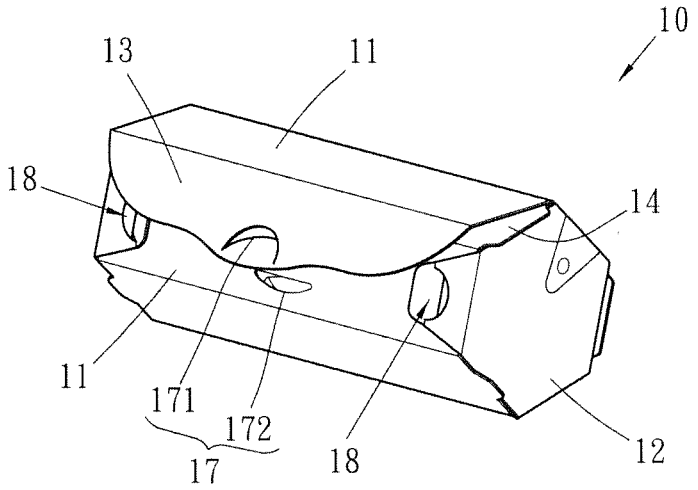
FIG. 7 shows that the first extension portion is folded.
Figure 8:
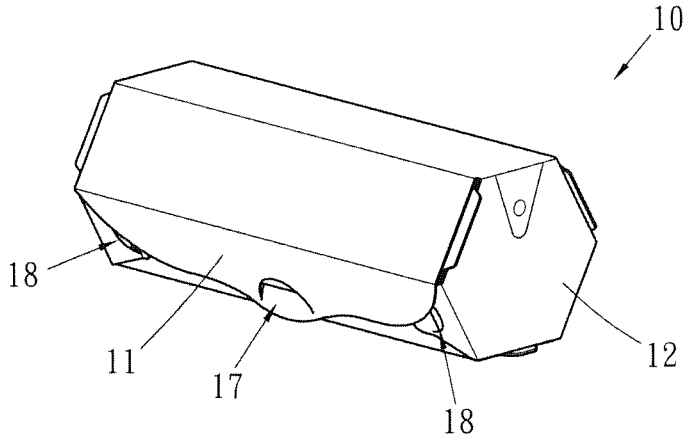
FIG. 8 shows that the first engaging portion is connected to the second engaging portion.

As shown in FIGS. 3 to 8, the support members 21, 22 are folded and then connected to the peripheral wall 11 and the object 30 extends through the engaging portions 23. The positioning portion 23 can be located close to or away from the distal end of the support member 21/22. The first extension portion 13, the peripheral wall 11 and the second extension portion 14 are folded to enclose the object 30. The end portions 12 are then folded toward the peripheral portion 11. As shown in FIG. 4, the flaps 15, 16 on the rear end of the packing box 10 are then folded, and the first engaging portions 181, 183 are engaged with the second engaging portion 182, 184. As shown In FIGS. 5 and 6, the flaps 15, 16 on the front of the packing box 10 are folded to engage the first engaging portions 181, 183 with the second engaging portion 182, 184. As shown in FIG. 7, the first extension portion 13 is overlapped on the second extension portion 14, and the first engaging portion 171 is engaged with the second engaging portion 172 to finish the packing box 10 as shown in FIG. 8.

Figure 9:
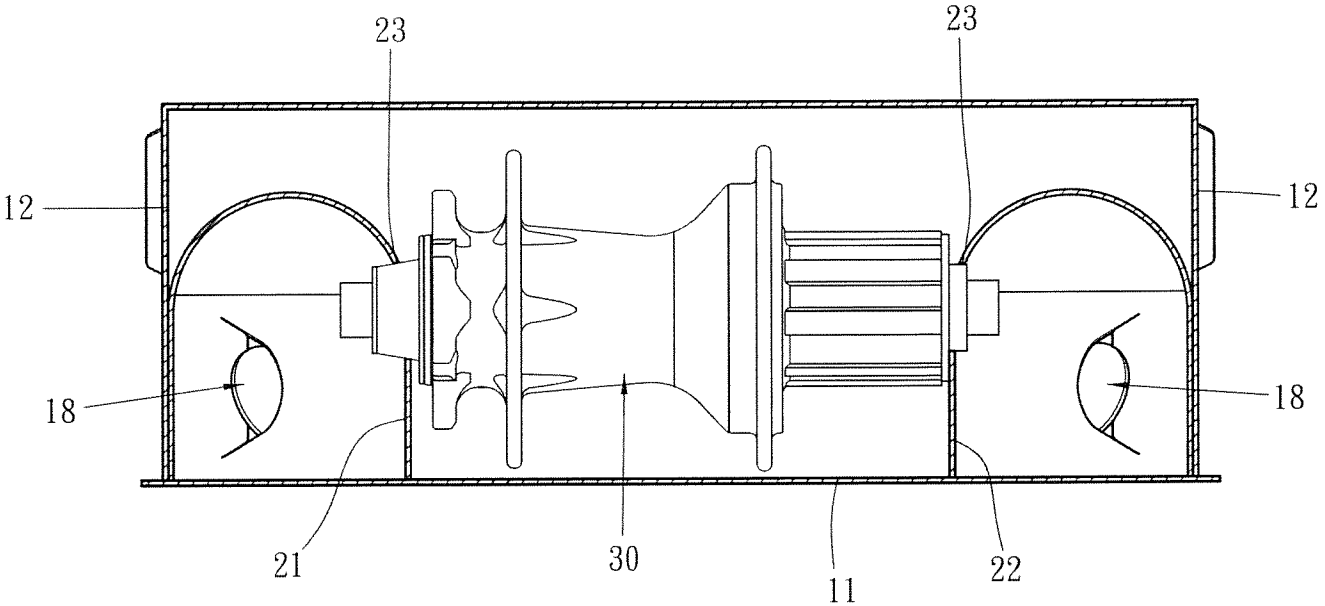
FIG. 9 is a cross sectional view to show that the object is supported by the support members.

As shown in FIG. 9, after the support members 21, 22 are bent, the distal ends are lowered, due to the weight of the object 30, and contact the peripheral wall 11. The height of the engaging portions 23 make the object 30 to be hanged in the packing box 10.

Figure 10:
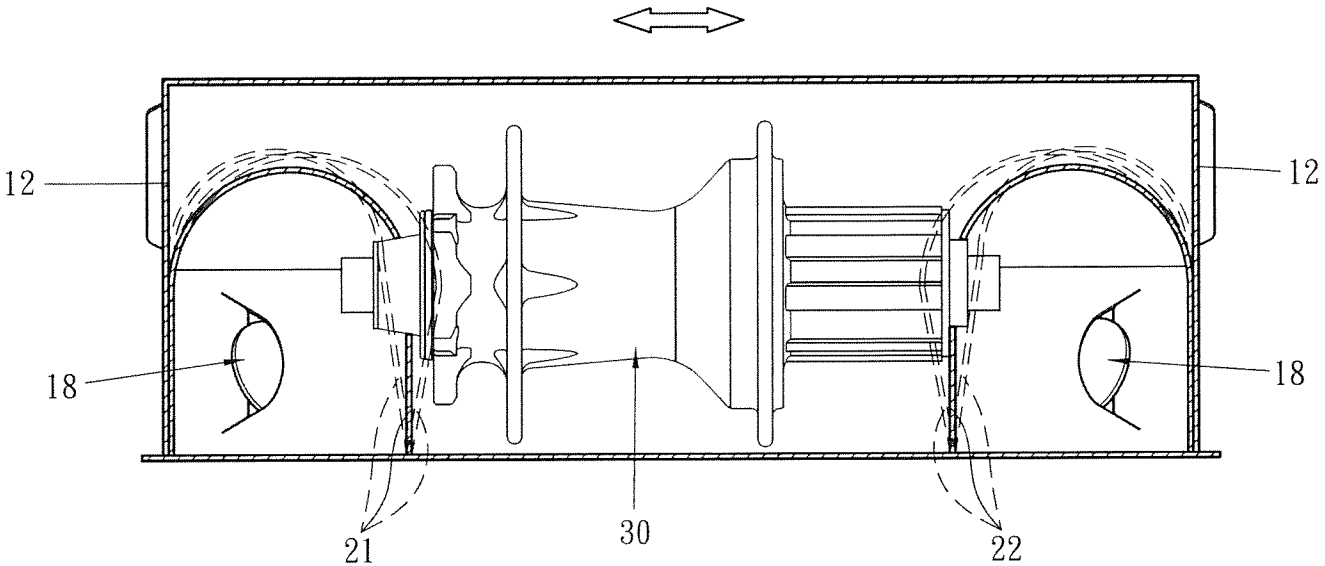
FIG. 10 shows the support members are moved due to vibration.

As shown in FIG. 10, when the packing box 10 is moved, because the support members 21, 22 are flexible so that the support members 21, 22 are linearly movable toward the end portions 12 corresponding thereto. The two support members 21, 22 swing back and forth to eliminate the energy from vibration and impacts, so that the object 30 is protected. The movement of the support members 21, 22 has a limit so that the object 30 does not hit the end portions 12.

The shock-absorbing device 20 is integrally formed when cutting the paper board and the height of the engaging portions 23 make the object 30 to be positioned and hanged in the packing box 10. The object 30 can swing with the support members 21, 22 to eliminate the vibration and impacts.

When the support members 21, 22 are bent, the object 30 is to be extended through the bent portions of the support members 21, 22, so that the length of the bent portion can be adjusted according to the length of the object 30. In other words, the packing box 10 can be used to pack the object of different lengths and this reduces the cost for preparing different sizes of the packing boxes.

The packing box 10 and the shock-absorbing device 20 are integrally manufactured, no polymer particles and bubble sheets are needed to be fill in the space in the packing box 10, so that the cost is reduced.

The first and second engaging units 17, 18 have plate-like first engaging portions 171, 181, 183 which are folded and engaged with the second engaging portions 172, 182, 184 to position the first and second extension portions 13, 14 and the end portions 12 to the peripheral portion 11. When in use, the first and second engaging units 17, 18 are connected to each other from outside of the packing box 20 so that the packing efficiency is higher than the conventional packing box whose extension portions have to be inserted into the box. The present invention is easily packed and unpacked.

Figure 11:
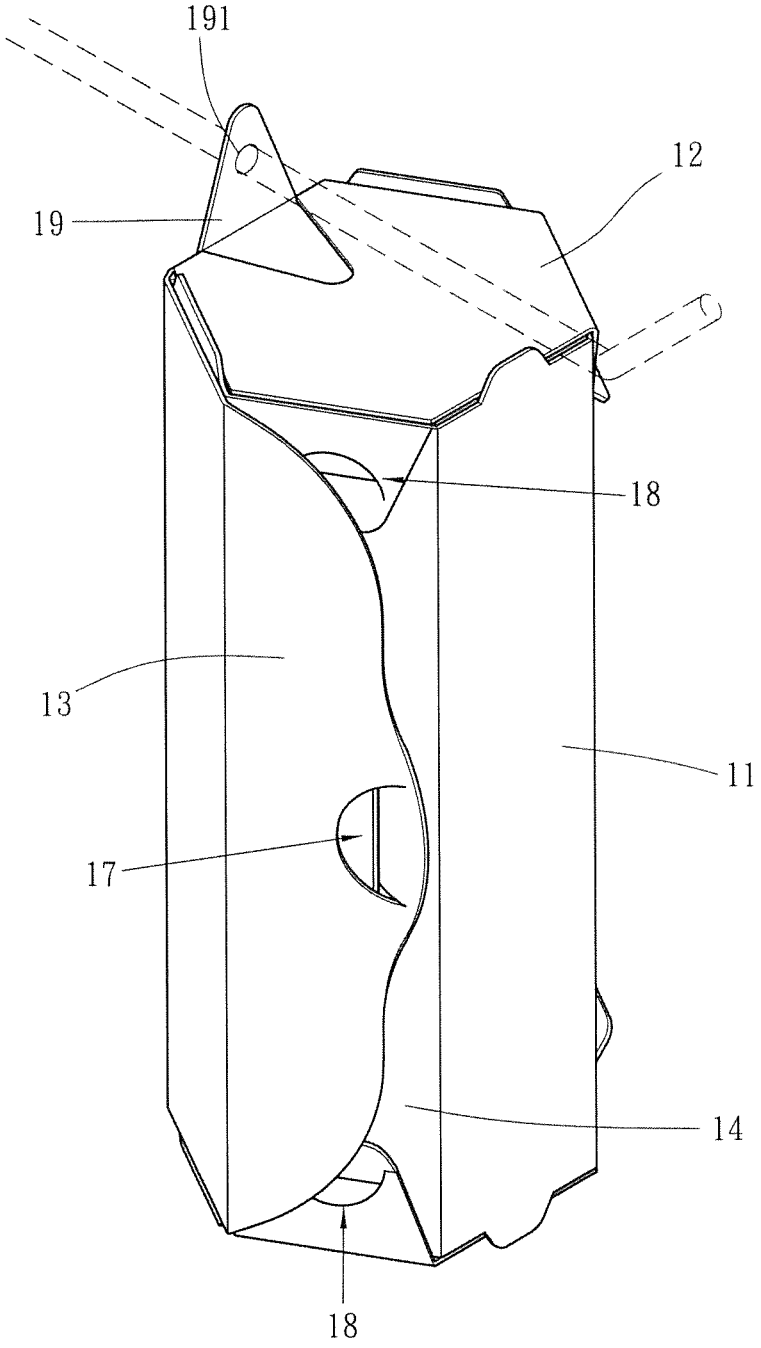
FIG. 11 shows that the packing box is hanged on a rod.

As shown in FIG. 11, when the lug 19 is pivoted outward, the packing box 10 can be hanged on a rod by the hole 191 in the lug 19.

Figure 12:
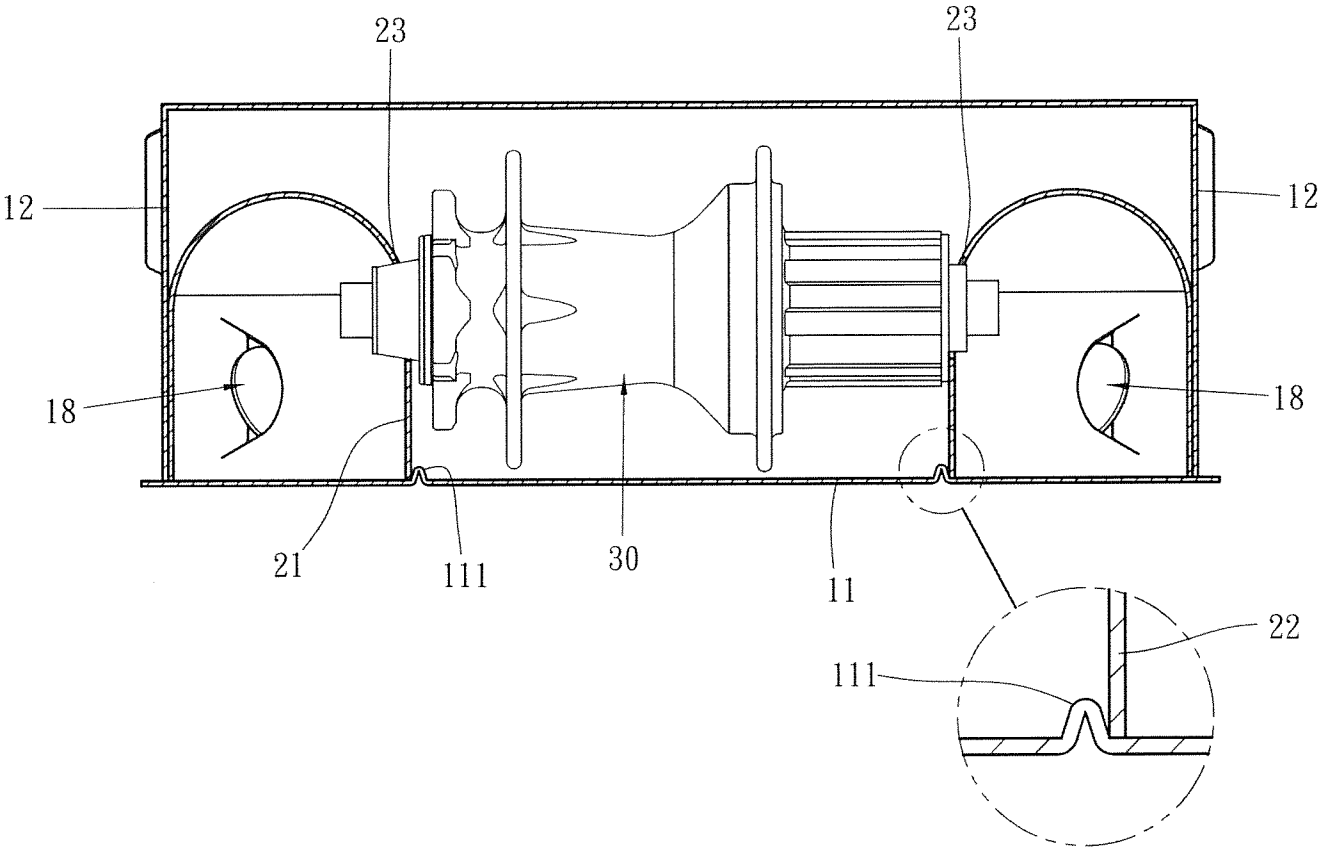
FIG. 12 shows the second embodiment of the packing box of the present invention.

FIG. 12 shows the second embodiment, wherein the peripheral portion 11 has a positioning protrusion 111 which faces the interior of the packing box 10, the distal end each of the bent support members 21, 22 contacts the positioning protrusion 111 so as to maintain the bent status of the support members 21, 22. The positioning protrusions 111 make the distal ends of the support members 21, 22 contact the peripheral portion 11 stably, while the bent portions of the support members 21, 22 are flexible.

Figure 13:
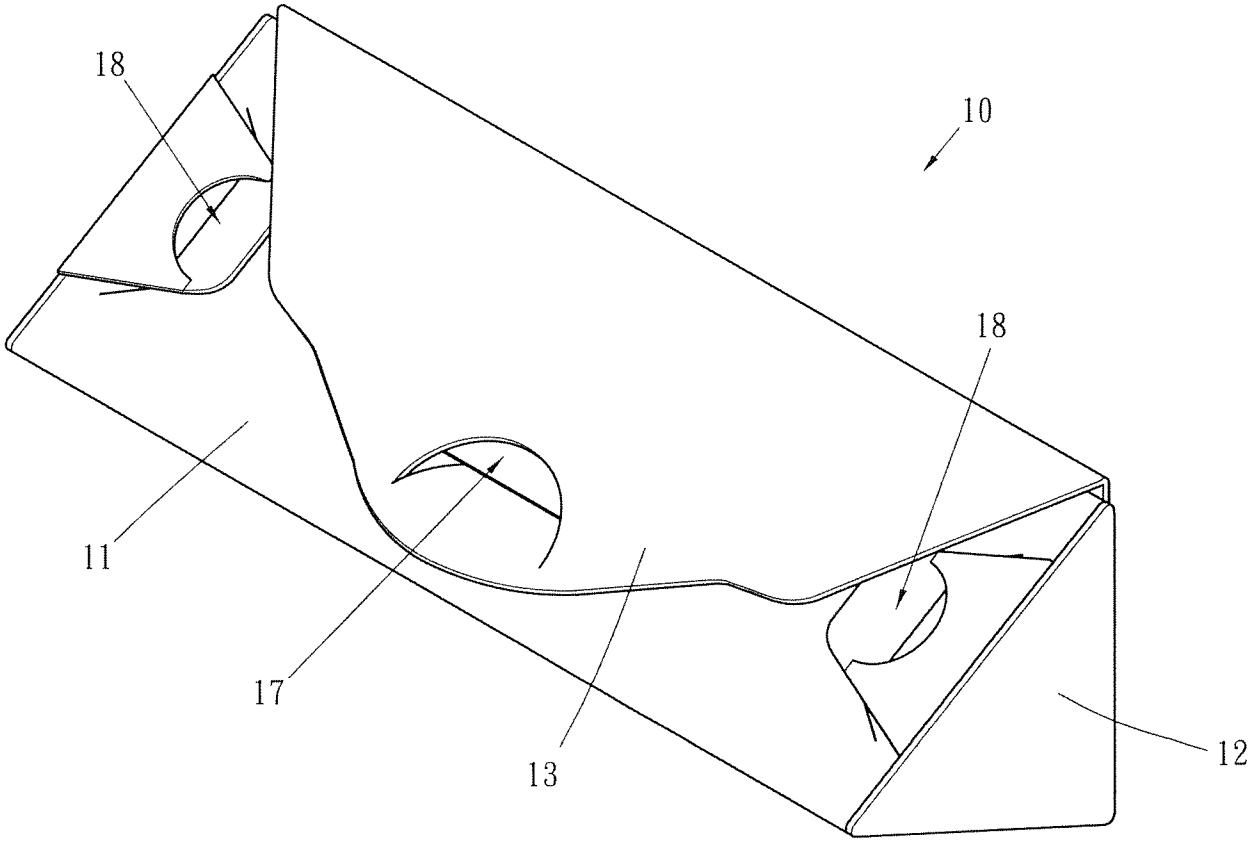
FIG. 13 is a perspective view to show the third embodiment of the packing box of the present invention.
Figure 14:
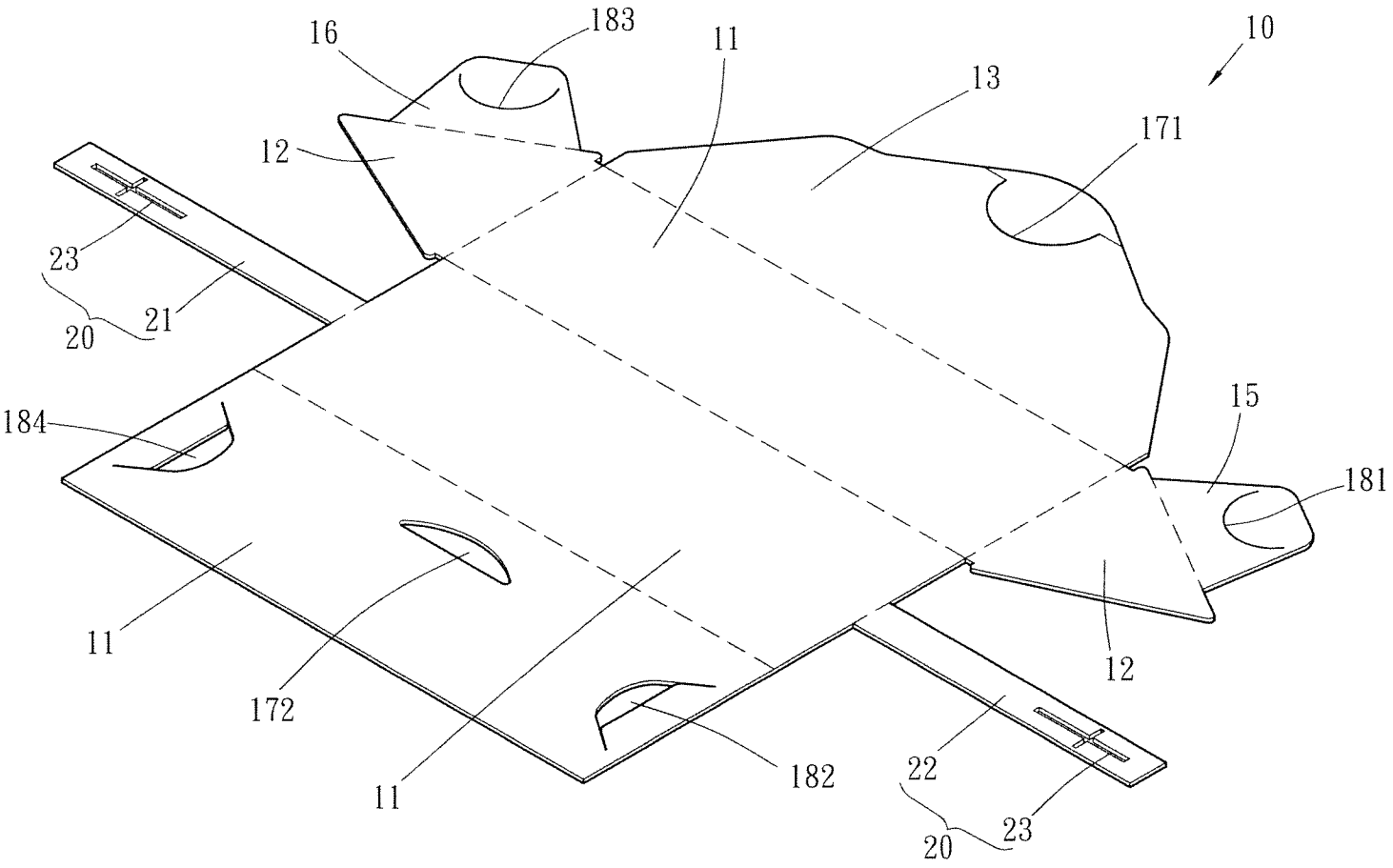
FIG. 14 shows that the third embodiment of the packing box of the present invention is expanded.
Figure 15:
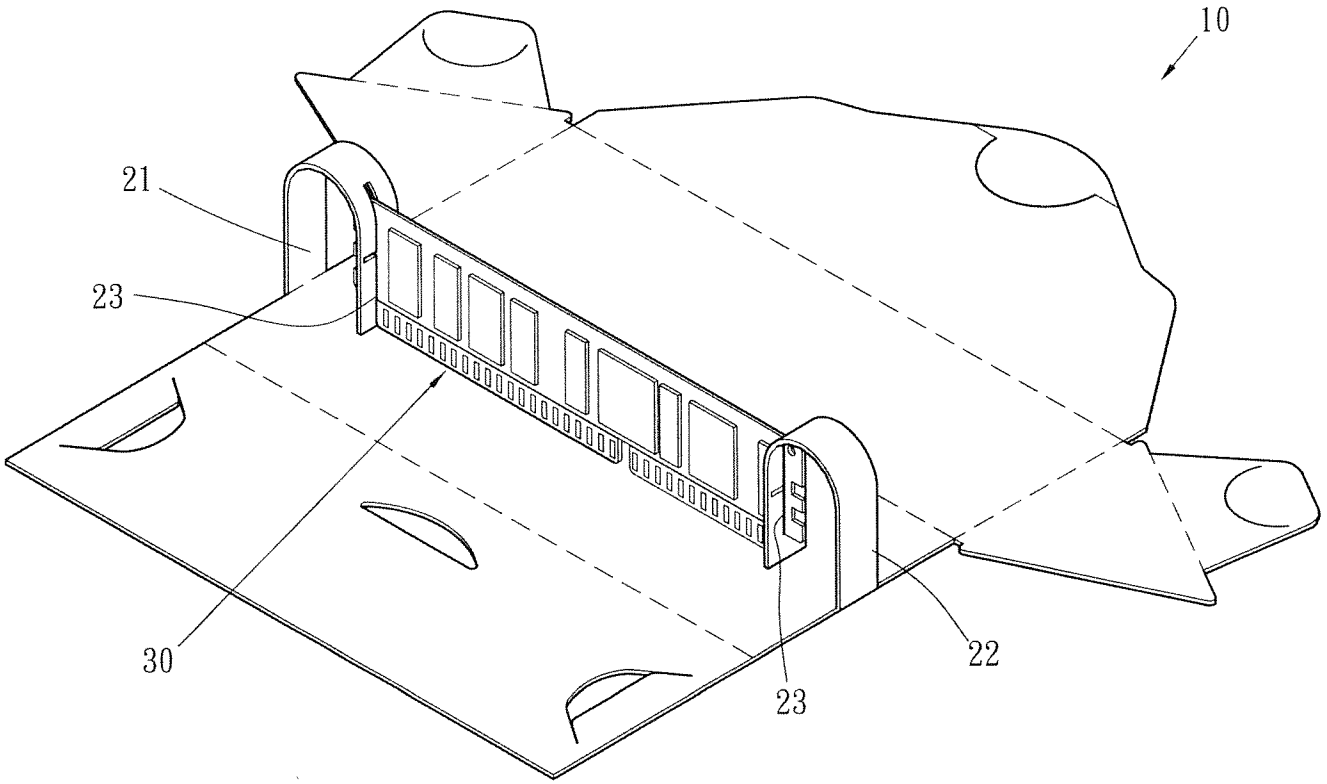
FIG. 15 shows that an object is positioned by the support members of the third embodiment of the packing box of the present invention.
Figure 16:
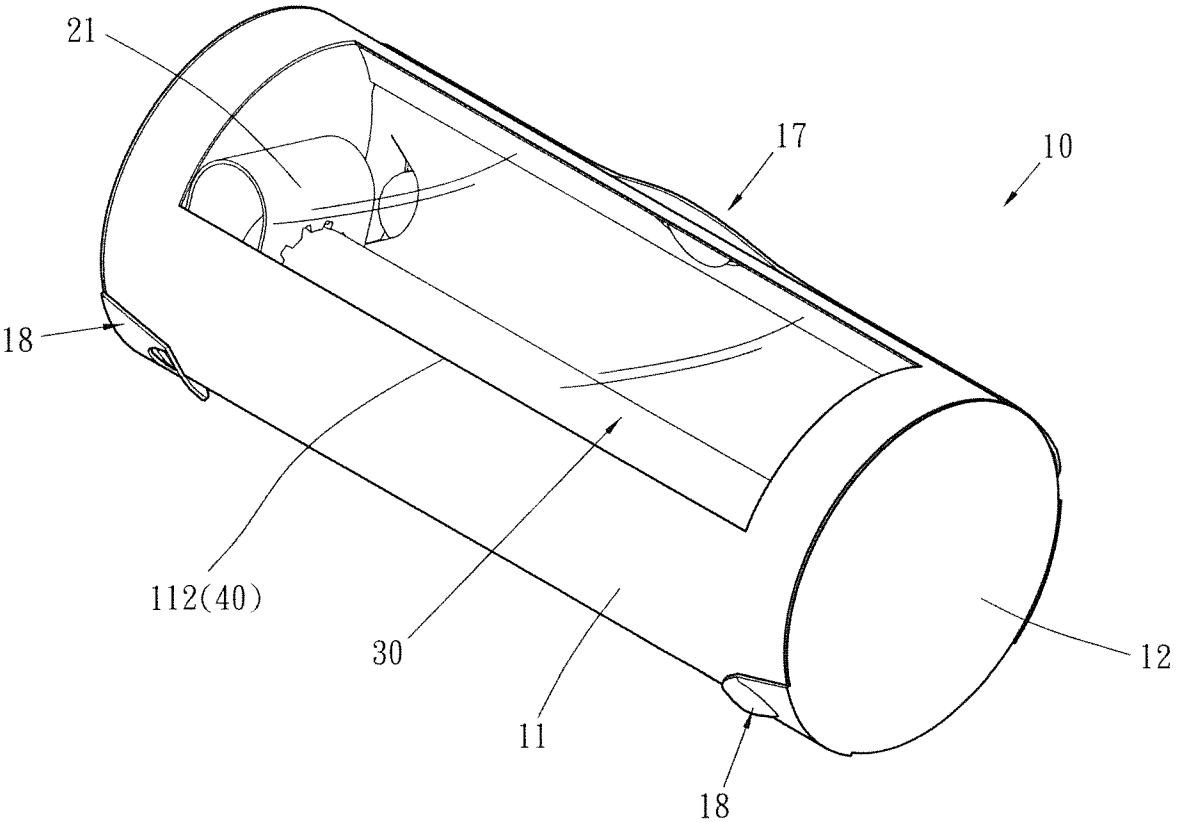
FIG. 16 is a perspective view to show the fourth embodiment of the packing box of the present invention.
Figure 17:
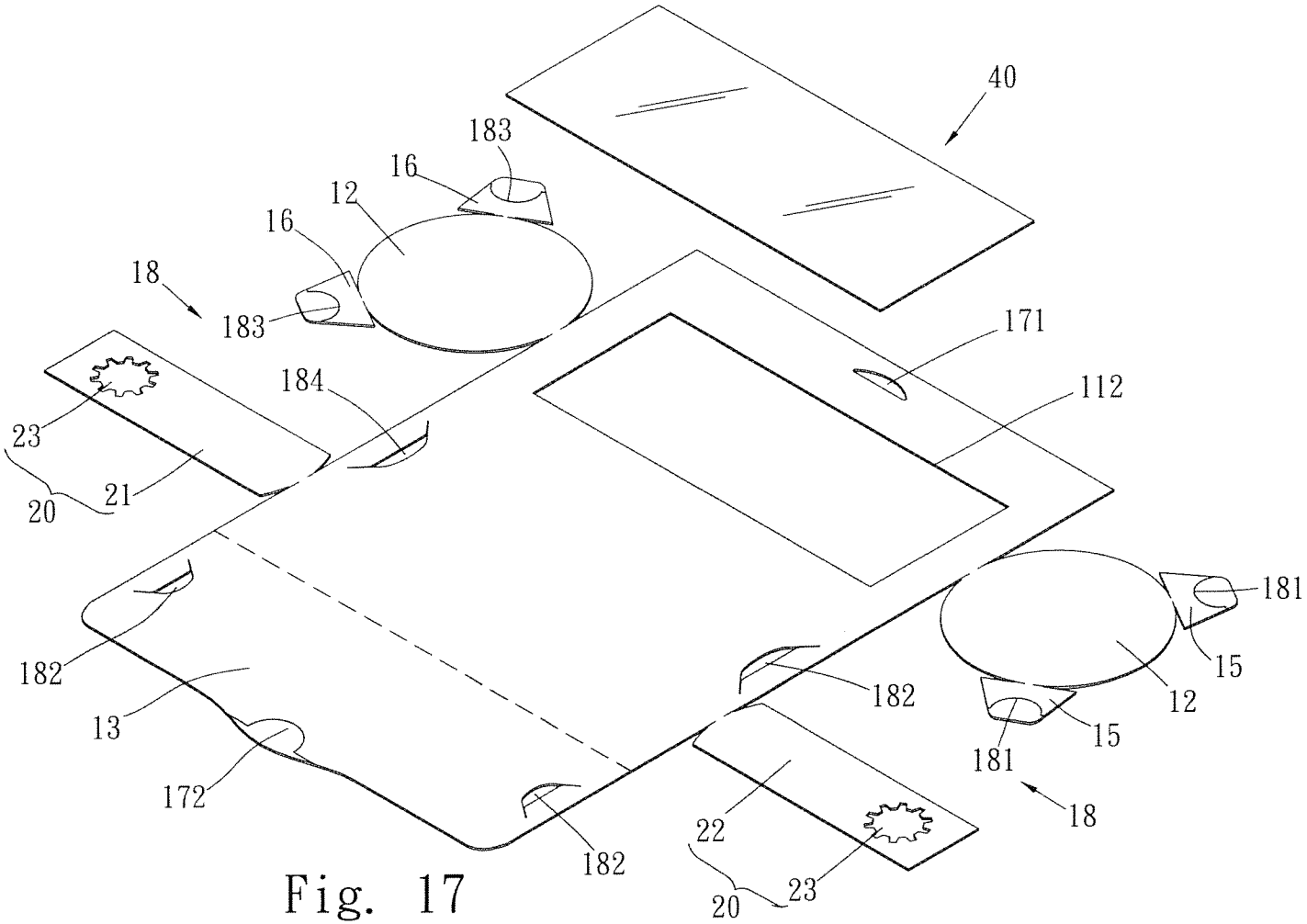
FIG. 17 shows that the fourth embodiment of the packing box of the present invention is expanded.
Figure 18:
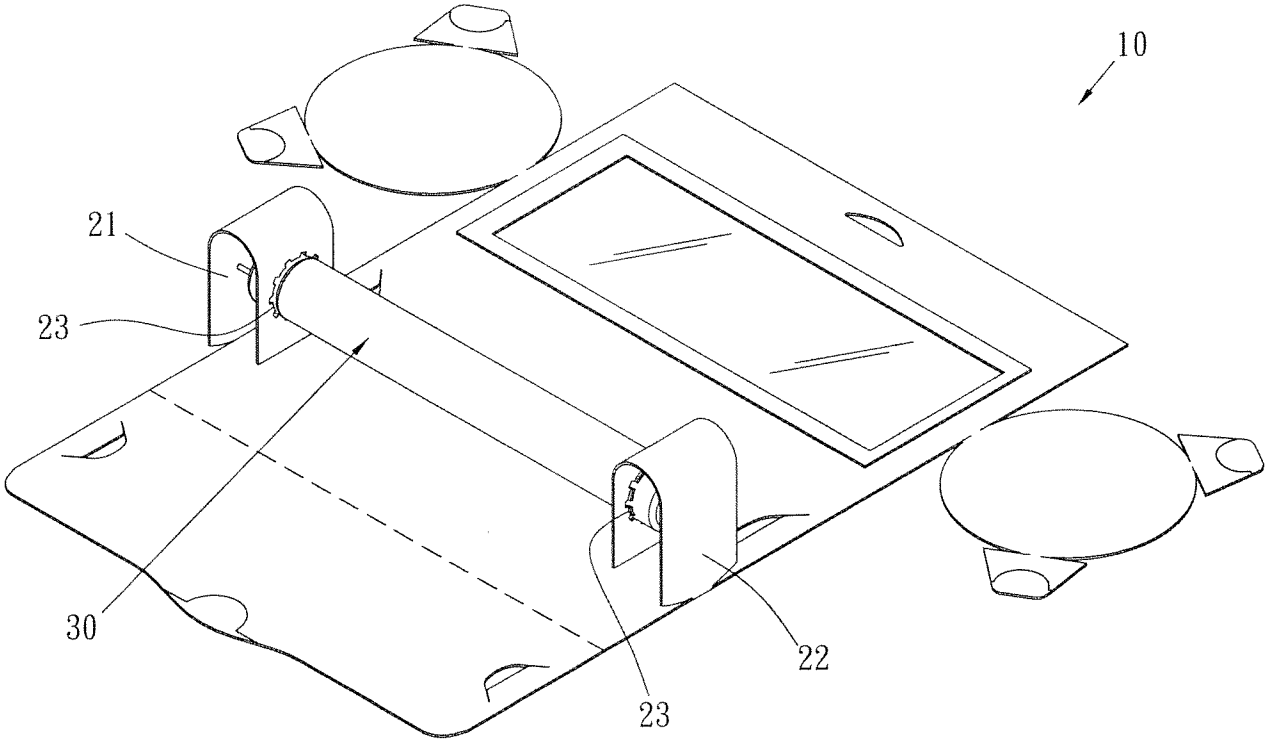
FIG. 18 shows that an object is positioned by the support members of the fourth embodiment of the packing box of the present invention.
Figure 19:
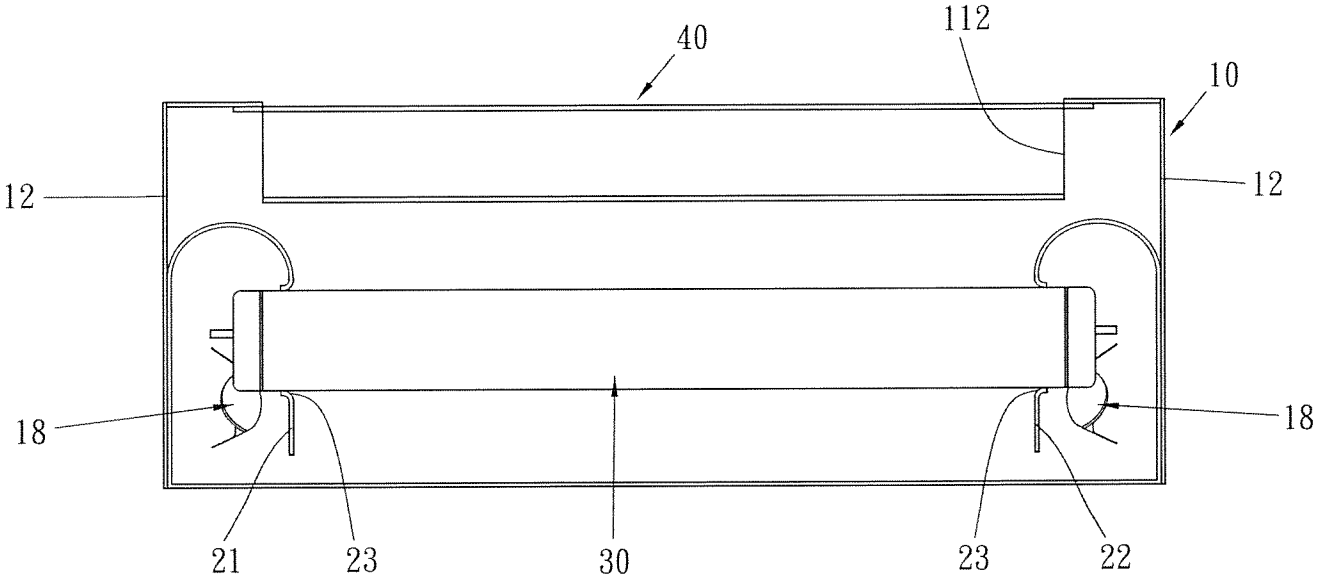
FIG. 19 is a perspective view to show the fourth embodiment of the packing box of the present invention.

FIGS. 13 to 15 show the third embodiment of the present invention, wherein the packing box 10 is a triangular box and the positioning portion 23 is a cross-shaped hole so that a thin object such as DRAM can be inserted therethrough. The number of the end portions 12 and the second engaging units 18 is limited, the embodiment only has the first extension portion 13 and does not have the second extension portion 14.

FIGS. 16 to 19 show the fourth embodiment of the present invention, wherein the packing box 10 is a cylindrical box and the peripheral portion 11 has a window 112 which communicates with the interior of the packing box 10 so that the object 30 can be observed via the window 112. A transparent member 40 is mounted to the window 112 to prevent dust from entering the interior. The positioning portion 23 is a hole with teeth defined in the inner periphery thereof.

Because the object is light in weight so that the distal ends of the support members 21, 22 do not hit the peripheral portion 11 so the object is hanged and can swing with the support portions 21, 22. In this embodiment, the positioning portion 23 is a hole with teeth defined in the inner periphery thereof so that the object 30 extends through the positioning portion 23 with less resistance and the teeth are flexible so that the diameter of the positioning portion 23 does not have to precisely match the size of the object 30. In other words, the positioning portion 23 can be used to position objects of different sizes.

The transparent member 40 is mounted to the window 112 to prevent dust from entering the interior and the object 30 can be observed via the window 112.

While we have shown and described the embodiment in accordance with the present invention, it should be clear to those skilled in the art that further embodiments may be made without departing from the scope of the present invention.

What is claimed is:

1. A packing box comprising:

a peripheral portion and two end portions respectively connected to two ends of the peripheral portion, each of the end portions having a flap which is bent to be located corresponding to the peripheral portion;

a first engaging unit connected to the peripheral portion and a second engaging unit having a first engaging portion located on the flap and a second engaging portion located on the peripheral portion, when the flaps are bent, the first and second engaging portions are connected to each other; and a shock-absorbing device having two support members located on the two ends of the peripheral portion, the two support members each being bent to be a U-shaped member and being linearly movable toward the end portion corresponding thereto, at least one positioning portion defined in each of the support members so as to be adapted to retain an object.

2. The packing box as claimed in claim 1, wherein each of the bent support members has a distal end which contacts the peripheral portion.

3. The packing box as claimed in claim 1, wherein the first engaging unit comprises a third engaging portion and a fourth engaging portion, the third and fourth engaging portions are located at a first position and a second position respectively, the third and fourth engaging portions are bent and connected to each other to maintain the packing box and a space in the packing box.

4. The packing box as claimed in claim 1, wherein the peripheral portion has a first extension portion and a second extension portion extending from two sides thereof, the first engaging unit has a third engaging portion which is located at the first extension portion, a fourth engaging portion is located on the peripheral wall, when the peripheral portion, the third extension portion and the fourth extension portion are bent, the third and fourth engaging portions are bent and connected to each other to maintain the packing box and a space in the packing box.

5. The packing box as claimed in claim 3 or 4, wherein the third engaging portion has a protrusion by partially cutting and the second engaging portion has a hollow portion with which the third engaging portion is engaged.

6. The packing box as claimed in claim 1, wherein the peripheral portion has a window which communicates with an interior of the packing box.

7. The packing box as claimed in claim 1, wherein the at least one positioning portion is located close to distal ends of the bent support members.

8. The packing box as claimed in claim 1, wherein the at least one positioning portion is a hole with teeth defined in an inner periphery thereof.

9. The packing box as claimed in claim 1, wherein the at least one positioning portion is a cross-shaped hole.

10. The packing box as claimed in claim 1, wherein one of the end portions has a lug which is cut from the end portion and a hole is defined through the lug.

11. The packing box as claimed in claim 1, wherein the first engaging portion has a protrusion by partially cutting and the second engaging portion has a hollow portion with which the first engaging portion is engaged.

12. A packing box comprising:

a peripheral portion and two end portions respectively connected to two ends of the peripheral portion, the peripheral portion having two positioning protrusions which face an interior of the packing box; and a shock-absorbing device having two support members located on the two ends of the peripheral portion, the two support members each being bent to be a U-shaped member and being linearly movable toward the end portion corresponding thereto, at least one positioning portion defined in each of the support members so as to be adapted to retain an object, each of the bent support members having a distal end which contacts the positioning protrusion corresponding thereto so as to maintain the bent status of the support members.

* * * * *